United States Patent [19]

Farris et al.

[11] 4,305,474

[45] Dec. 15, 1981

[54] THRUST ACTUATED DRILL GUIDANCE DEVICE

[75] Inventors: Nathandale Farris, Ponca City, Okla.; Hilbert D. Dahl, Pittsburgh, Pa.

[73] Assignee: Conoco Inc., Ponca City, Okla.

[21] Appl. No.: 117,905

[22] Filed: Feb. 4, 1980

[51] Int. Cl.[3] ..... E21B 7/08

[52] U.S. Cl. ..... 175/73; 175/107; 175/325; 175/76

[58] Field of Search ..... 175/73, 76, 61, 325, 175/107

[56] References Cited

U.S. PATENT DOCUMENTS 3,098,534 7/1963 Carr et al. ..... 175/325

3,129,776 4/1964 Mann ..... 175/76

3,853,186 12/1974 Dahl et al. ..... 175/73

3,888,319 6/1975 Bourne, Jr. ..... 175/76

*Primary Examiner*—James A. Leppink

*Attorney, Agent, or Firm*—Richard W. Collins

[57] ABSTRACT

A device for providing directional control to a borehole being drilled. The device is used with a drilling system including a drill string, a downhole motor and a bit rotated by the downhole motor. The device exerts a deflecting force perpendicular to the axis of the drill string when a lower than normal thrust is imposed on the drill string, and exerts an opposite perpendicular force when a higher than normal thrust is imposed on the drill string. When normal thrust is being used, the device does not cause deflection in either direction.

3 Claims, 6 Drawing Figures

THRUST ACTUATED DRILL GUIDANCE DEVICE

BACKGROUND OF THE INVENTION

This invention relates to apparatus for drilling generally horizontal boreholes in a subterranean earth formation, and more particularly to a device for controlling the trajectory of such a borehole to maintain same within the upper and lower boundaries of a mineral bed such as a seam of coal.

The drilling of long generally horizontal gas drainage holes in coal beds is known in the art as a method for degasifying a coal bed in advance of mining. The gas drainage holes drilled in this manner are either vented or connected to a vacuum source to remove methane from a coal bed. The greatest problem encountered in drilling these gas relief holes is that of maintaining the bit trajectory within the coal seam such that the resulting holes are actually through the coal seam rather than through an overlying or underlying formation. Control of borehole trajectory is also important in exploratory drilling for coal or other minerals.

DESCRIPTION OF THE PRIOR ART

Deflection devices for controlling the direction of boreholes being drilled in a mineral seam are described in U.S. Pat. Nos. 3,853,186 and 3,888,319. The deflection device illustrated in FIGS. 10, 11, and 12 of U.S. Pat. No. 3,888,319 is believed to be the most pertinent prior art relating to the present invention.

SUMMARY OF THE INVENTION

According to the present invention, a drilling system comprising a drill string, a downhole motor and a bit is provided with a thrust actuated deflection device. The deflection device exerts a perpendicular force against the drill string in a first direction when a lower than normal thrust is exerted on the drill shaft, and in a second opposite direction when a higher than normal thrust is exerted on the drill shaft.

A fixed-volume closed hydraulic system linking the drill string and the deflection device is responsive to the thrust on the drill string, and under high thrust causes the deflection device to exert a perpendicular force on the borehole wall. When low thrust is used, bias springs cause the device to exert an opposite perpendicular force on the borehole wall.

The borehole direction and relation to the mineral seam can be periodically determined by available survey instruments, and the direction of the borehole can be varied as needed by use of the deflection device of this invention.

DESCRIPTION OF THE PREFERRED EMBODIMENT

Figure 1:
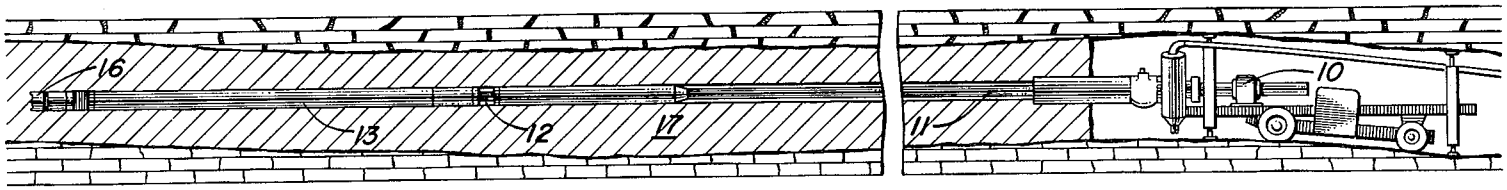
FIG. 1 illustrates a drilling system of the type to which the invention is applicable.

A drilling system of the type to which the present invention pertains is shown generally in FIG. 1, and includes a drilling machine 10 in a work area of an underground mine. Drilling machine 10 is a conventional device capable of exerting a controlled thrust on drill string 11 extending from the drilling machine to a thrust actuated piston 12 located on drill string 11 adjacent downhole motor 13.

Figure 2:
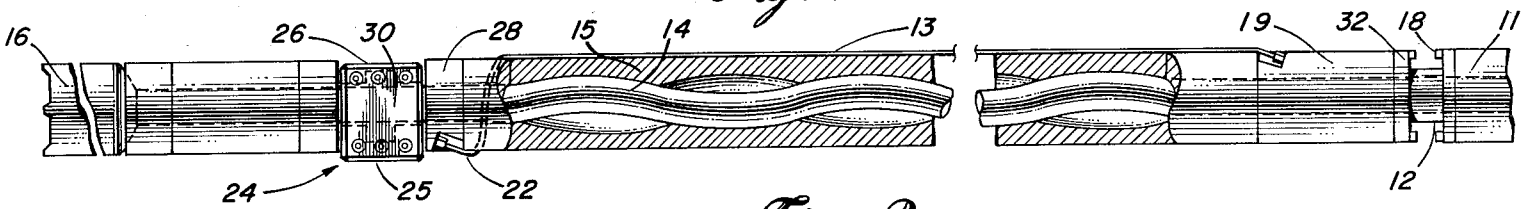
FIG. 2 is a side elevation, partially cut away, illustrating a downhole motor, a drill bit, and the deflection device of the invention.
Figure 4:
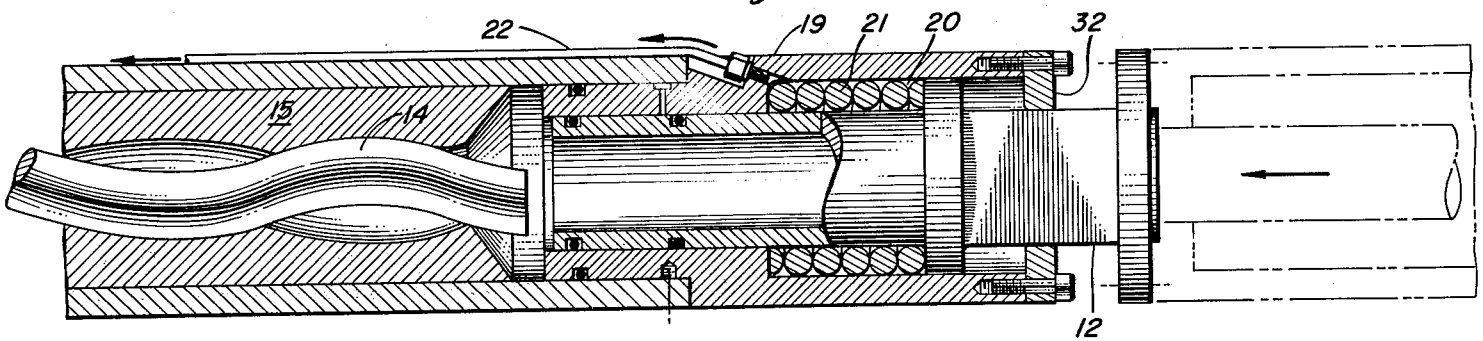
FIG. 4 is a cross section showing the thrust-operated hydraulic piston in the extended position corresponding to high thrust on the drill string.

Downhole motor 13, as shown more clearly in FIG. 2, is a fluid-operated rotary motor of the type commonly referred to as a Moyno motor, and includes a rotor 14 which rotates in housing 15 in response to fluid flow from drilling machine 10 down the interior of drill string 11 and out through drill bit 16. Drill bit 16 is coupled to rotor 14 by shaft 31 (FIGS. 3*a* and 4*a*) and turns in response to fluid flow through downhole motor 13. The fluid from drill bit 16 returns through the borehole outside drill string 11 to drilling machine 10 (FIG. 1) where drill cuttings are separated. The fluid is then recirculated through drill string 11, all in a known manner. Other types of downhole motor could be used.

The long, generally horizontal boreholes which are drilled using the device of this invention may be for degasification of a coal seam in advance of mining, or may be for exploration purposes. In degasification, for example, it is important to maintain the borehole trajectory in a coal seam 17 (FIG. 1) between overlying and underlying layers of shale or other non-coal material.

Borehole survey instruments are available which indicate the position of a borehole relative to the mineral seam boundary, and numerous techniques have been used to maintain a borehole within a mineral seam based on the readings from survey instruments.

One method of controlling borehole trajectory involves use of a deflection device which exerts a perpendicular force on the drill string near the drill bit. This technique, described in U.S. Pat. No. 3,888,319, uses a fluid-controlled deflection device which has a hydraulic line extending from the deflection device to the working area outside the borehole. Obviously, a line of such length in the environment of an underground mine is subject to operating difficulties.

According to the present invention, a deflection device can be controlled by fluid pressure without the necessity of a long conduit extending the entire length of the drill string.

The thrust-actuated deflection device of this invention is illustrated in FIGS. 2, 3, 3*a*, 4, and 4*a*. As shown therein, piston 12 is connected to drill string 11 by bolts 18 (FIG. 2). Piston 12 is shaped at its rear end and guided by strips 32 bolted to housing 19 so that housing 19 does not rotate relative to drill string 11. A fluid-containing chamber 20 between piston 12 and housing 19 contains fluid and a strong spring 21.

Figure 3:
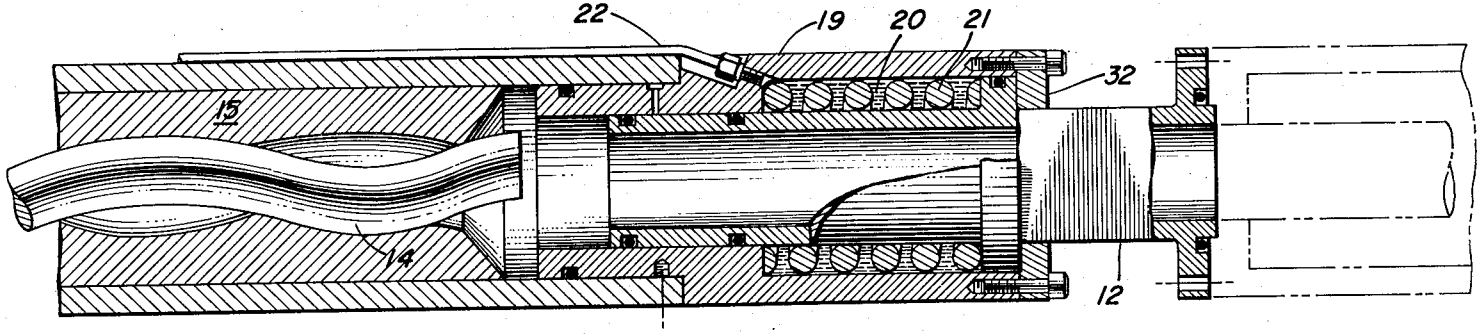
FIG. 3 is a cross section showing the thrust-operated hydraulic piston which operates the deflection device, the piston being in the retracted position corresponding to low thrust on the drill string.
Figure 3A:
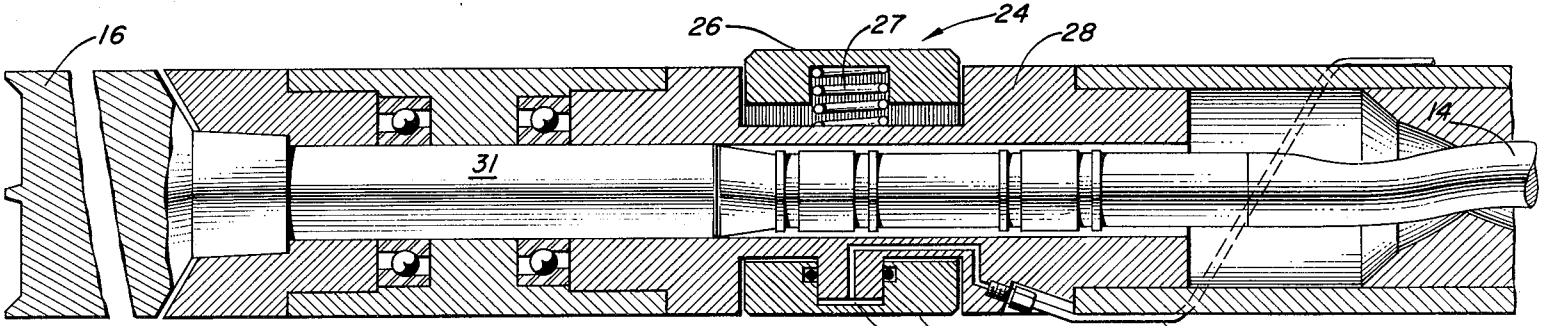
FIG. 3*a* is a cross section showing the deflection device of the invention in its retracted position corresponding to the piston position of FIG. 3.
Figure 4A:
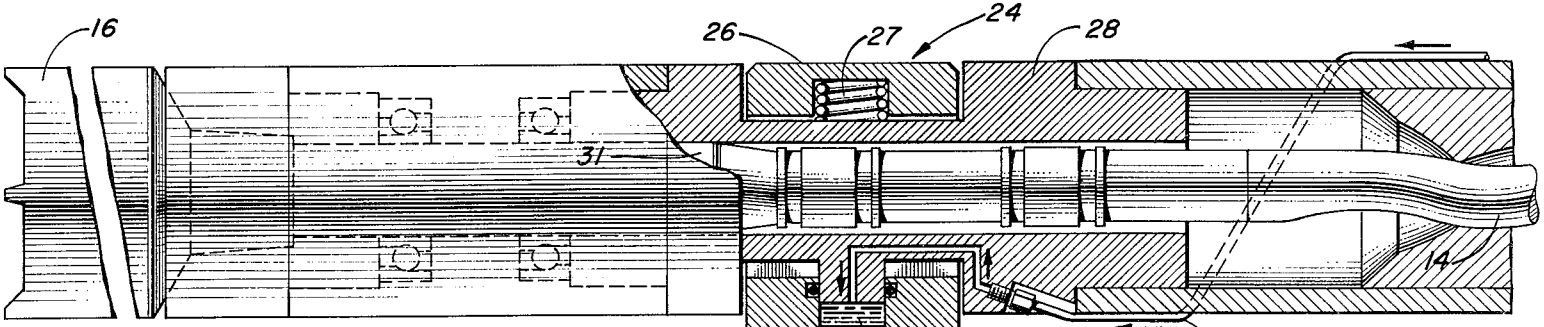
FIG. 4*a* is a cross section showing the deflection device of the invention in its extended position corresponding to the piston position of FIG. 4.

Conduit 22 extends from chamber 20 to cylinder 23 in lower wall-engaging shoe 25 (FIGS. 3*a* and 4*a*).

Deflection device 24 includes a lower wall-engaging shoe 25. As seen in FIG. 2, lower wall-engaging shoe 25 is connected to a spring-containing upper wall-engaging shoe 26 by side plates 30 and the unit slides over body member 28 (FIGS. 3*a* and 4*a*) perpendicularly to the drill string axis in response to fluid from conduit 22 filling the cylinder 23 in lower shoe 25 and overcoming the bias of spring 27 in upper shoe 26. Body member 28 encompasses rotatable shaft 31 which connects rotor 14 and bit 16.

Returning to FIGS. 3 and 4, FIG. 3 shows the position of piston 12 when the thrust on drill string 11 is insufficient to compress spring 21. Spring 21 is selected to remain extended as in FIG. 3 when lower than normal thrust is exerted on piston 12. When higher thrust is exerted on piston 12 through drill string 11, piston 12 moves to the position shown in FIG. 4. This movement compresses spring 19, reducing the fluid volume in chamber 20, and fluid displaced from chamber 20 flows through conduit 22 to cylinder 23 in lower shoe 25 of deflection device 24 (FIG. 4*a*). This causes lower wall-engaging shoe 25 to extend outwardly to a borehole wall-engaging position (FIG. 4*a*), exerting an upward force on drill bit 16 and causing an upward trajectory to the borehole being drilled. When normal drilling thrust is being used, piston 12 is in a position intermediate those shown, and no deflecting force occurs.

Top shoe 26 extends beyond body member 28 when piston 12 is in the retracted position (FIG. 3*a*), thereby exerting a downward force on the drill bit.

Springs 21 and 27 are selected to maintain deflection device 24 in a neutral position when a normal drilling thrust is utilized. This force depends on such things as size of drilling equipment, material being drilled, etc. The springs are preferably selected to provide full movement from the retracted to extended positions upon variation of the drilling thrust by about 50 percent below and above normal.

Thus, this invention provides a means for controllably exerting a force perpendicular to a borehole being drilled, thereby making it possible to steer a drill bit within a mineral seam. The invention provides a means for accomplishing this without the need for a hydraulic line extending from the deflection device to the working area, and provides directional control based on drill string thrust.

Operation

The operation of a drilling system utilizing the deflection device of this invention will be described with reference to the drawings.

In FIG. 1, a borehole is being drilled in coal seam 17. Drilling fluid from drilling machine 10 flows through drill string 11 to downhole motor 13, causing rotation of rotor 14 and bit 16 in a known manner. Drilling machine 10 applies a controlled thrust to drill string 11 to advance bit 16 through coal seam 17. Periodically, survey instruments are utilized to determine the relation of the borehole to the coal seam boundary, and if the borehole is, for example, approaching the bottom of coal seam 17, a higher thrust is applied to drill string 11. This higher thrust causes piston 12 to move from the position shown in FIG. 3 to that shown in FIG. 4. This in turn causes lower wall-engaging shoe 25 to move from the position shown in FIG. 3*a* to that shown in FIG. 4*a*. In the extended position, lower shoe 25 presses against the bottom of the borehole, causing an upward force on bit 16 with a resulting upward borehole trajectory.

If a later survey indicates the borehole is centered in the coal seam, the normal drilling thrust is utilized, and the upward angle of the borehole will not increase further.

If the top of the coal seam is approached, a reduced thrust is utilized. With reduced thrust, springs 21 and 27 act to extend upper shoe 26 against the top of the borehole, causing a downward change in the hole angle.

Thus, it can be seen that this invention provides capability for steering a drill bit through a mineral seam by varying the thrust on the drill bit.

We claim:

1. A deflection device for use in a drilling system wherein a drill string extends to a downhole motor which drives a rotatable shaft connected to a drill bit, said deflection device comprising:

(a) a body member adapted to encompass part of said rotatable shaft;

(b) oppositely disposed first and second borehole wall contacting members, said members being joined together and adapted for sliding movement over said body member in a direction perpendicular to said shaft, one of said wall contacting members being spring biased outwardly by a spring means therein and the other of said wall contacting members being movable outwardly in response to fluid pressure applied to an internal chamber therein;

(c) a thrust-actuated piston attachable to a drill string;

(d) a piston housing slidably encompassing a portion of said thrust-actuated piston to provide a cavity between said housing and said piston, the volume of said cavity being variable will relative longitudinal movement of said housing and piston;

(e) a spring means in said cavity adapted to urge said piston to a position where said cavity has maximum volume; and (f) fluid conduit means extending in fluid communication between said cavity and said internal chamber in the other of said borehole wall contacting members whereby movement of said piston relative to said housing causes fluid to move between said cavity and said internal chamber, thereby moving said borehole wall contacting members relative to said body member.

2. The device of claim 1 wherein said spring means in said wall contacting member and said spring means in said cavity are selected to maintain the borehole wall contacting members in a neutral position when a normal drilling thrust is utilized, to maintain said spring biased borehole wall contacting member against a borehole wall when a lower than normal drilling thrust is utilized, and to allow the other of said borehole wall contacting members to extend against a borehole wall when a higher than normal drilling thrust is utilized.

3. The device of claim 2 wherein the other of said borehole wall contacting members is fully extended upon application of a drilling thrust 50 percent higher than normal drilling thrust.

* * * * *